United States Patent [19]

Hagen

[11] Patent Number: 5,014,447

[45] Date of Patent: May 14, 1991

[54] POSITIVE PRESSURE WEB FLOATER DRYER WITH PARALLEL FLOW

[75] Inventor: Kenneth G. Hagen, Cape Elizabeth, Me.

[73] Assignee: Thermo Electron Web Systems, Inc., Auburn, Mass.

[21] Appl. No.: 154,289

[22] Filed: Feb. 10, 1988

[51] Int. Cl.[5] ..... F26B 13/00

[52] U.S. Cl. ..... 34/156; 226/97

[58] Field of Search ..... 34/156, 160, 155, 10; 226/97

[56] References Cited

U.S. PATENT DOCUMENTS

| | | | |
|---|---|---|---|
| 3,587,177 | 6/1971 | Overly | 34/156 |
| 3,873,013 | 3/1975 | Stibbe | 226/97 |
| 4,336,479 | 10/1979 | Overly | 34/156 |
| 4,414,757 | 11/1983 | Whipple | 34/155 |

*Primary Examiner*—Henry A. Bennet

*Attorney, Agent, or Firm*—Lorusso & Loud

[57] ABSTRACT

A modified double slot impingement nozzle for floater dryers is used to maximum advantage by optimizing the relationships of the spacing between the nozzles and the nozzle lengths for each row of nozzles along the web. The nozzle is also used to advantage by optimizing the slot width of the secondary jet of the nozzle in relation to the slot width of the primary jet.

2 Claims, 11 Drawing Sheets

POSITIVE PRESSURE WEB FLOATER DRYER WITH PARALLEL FLOW

BACKGROUND OF THE INVENTION

This invention relates to web dryers which are used in the manufacture of coated paper, film and foil and related processes such as printing.

Floater dryers are preferred for many web drying processes because they permit the web to be transported on a cushion of heated air such that it has no physical contact with any solid member such as a conveyer or roll until its surface is dry or cured. The air cushion provides support while drying the web. Furthermore, the absence of mechanical support members for the web allows the heat for drying to be applied intimately and uniformly to both sides of the web simultaneously. In this way drying intensity can be very high if desired.

The technology of floater drying has experienced substantial development in the past twenty years and certain important and desirable features have been discovered and quantified. Two basic types of nozzles have evolved, a single slot nozzle and a double slot impingement nozzle.

One of these nozzles, the single slot, nozzle 101 is described in U.S. Pat. No. 3,587,177 and is illustrated in FIG. 1. A plurality of these nozzles arranged in staggered formation on each side of the web 11 constitute a dryer. Heated air emerges from a single slot 103 and is turned around a curved surface to flow parallel to the travel direction of the web. The nozzle 101 creates what is known as the "Coanda effect" wherein the air does not impinge directly into the web and is constrained between the web 11 and a parallel plate 105 for a nominal distance (50–150 mm) to achieve high heat transfer. The heated air flow then continues for a similar distance beyond the trailing edge of the plate as a free wall jet parallel to and adjacent to the web. Finally, as the air flow approaches the next nozzle in sequence, it turns and flows away in the space between the nozzles.

This single slot nozzle 101 which creates the "Coanda effect" has seen extensive use worldwide. The single slot nozzle 101 provides high heat transfer which is uniform across the machine and fairly uniform in the direction of web movement. Because of the parallel direction of the air flow and web movement, the heat transfer can be further augmented by passing the web through the dryer such that it flows counterflow to the direction of the air. The local uniformity of heat transfer and consequent drying has beneficial effects to the quality of certain products and coatings dried on this type of machine. Since air flows are unidirectional, interacting streams of air are avoided which has benefits to cross-machine flow uniformity and web stability.

With the single slot nozzle 101, there is no positive pressure pad between the parallel plate 105 and the web 11. As a result, the web 11 travels through the dryer in a flat plane at a distance from the plate of about 2.5 times the width of the slot. Accurate alignment and parallelism of the nozzles 101 is required to avoid web 11 flutter at low tensions. At high tensions, webs have a tendency to curl at the edges and develop longitudinal wrinkles. When this occurs the possibility of contact between the web 11 and nozzles 101 is high. Thus, this type of nozzle 101 has limitations in some kinds of drying situations.

The principal alternative type of nozzle, the double slot impingement nozzle 107, is described in U.S. Pat. No. 3,873,013 and is illustrated in FIG. 2. This double slot impingement nozzle incorporates two slots 109 which blow air normal to the web 11. In this manner, a pocket of air at positive pressure is entrapped between the jets. A major portion of the air flow from the jets impinges against the web and flows away from both slots 109 on the nozzle 107. Some of this air rebounds directly away from the web 11 and some flows along the web 11 until it meets the corresponding stream from the adjacent nozzle. Heat transfer with this double slot nozzle 107 is comparable on average to the parallel flow type of nozzle under the same fan power conditions; however, there is much variability in heat transfer in the machine direction. In the immediate vicinity of the impinging jets, heat transfer is very high, but between each jet in the pair on the nozzle and in the region between the nozzles, it is quite low. For sensitive products, the high impingement heat transfer of this nozzle can cause quality problems. Interaction of the exiting streams of air between the nozzles can introduce web instability if the nozzles are placed too close together.

A very important feature of this double slot impingement type of nozzle is the positive pressure pad 111 formed between the impingement jets. Not only does this tend to keep the web 11 away from spurious contact with the nozzle 107, the staggered arrangement on each side of the web imparts an undulating motion to the web in the machine direction something like a sine wave. This corrugation effect gives the web some physical stiffness in the cross-machine direction which strongly resists tendencies to curl at the edges and to form wrinkles. This important feature of the double slot impingement nozzle also renders it less sensitive to dimensional accuracy in the positioning and alignment of the nozzles.

The pattern of pressure pads formed by the double slot impingement nozzle as arranged in a typical dryer is illustrated in FIG. 3 with pressure profile 113 and nozzle 107. It is characterized by the large spikes opposite the slots which are caused by stagnation of the air velocity at the web, a generally uniform elevated pressure between the spikes and a region to each side of the pressure pad where there is essentially no positive pressure.

The effect on the web of such a pattern of pressure pads is illustrated in FIG. 4 which also shows the local relationship between the pressure, the web tension and the radius of curvature of the web. For a local incremental region of constant pressure, the following equation applies:

$$R = \frac{T}{P}$$

where R is the radius of curvature, T is the web tension and P is the local pressure applied to the web. If P is zero, the radius of curvature is infinite which mathematically indicates that the sheet will be flat. If P is constant, the radius of curvature is a circular arc.

FIG. 5, FIG. 6, and FIG. 7 show the variation in web curvature for three different nozzle assemblies. FIG. 5 shows that the single slot nozzle causes the web to form a jagged undulation wave. Although the web undulates it has no curvature and therefore can curl locally. A double impingement nozzle applies pressure to the web over a finite distance b as shown in FIG. 6. Thus, ignoring the local effect of the spikes shown in FIG. 3, the generally constant pressure region will produce circular arc curvature over the pressure region with generally flat segments between them. This is a much better arrangement than is shown in FIG. 5 but the segments of the web having no curvature are still subject to local curl.

FIG. 7 shows that if the pressure region is made to be equal to half the undulation wave length, curvature is obtained throughout the length of the web. This is the objective condition for maximum resistance to curl. To achieve this with the double impingement nozzle requires that they be spaced on a pitch that is exactly twice the nozzle length dimension in the direction of the web movement. As discussed earlier, double impingement nozzles cannot be placed close together because of flow instabilities associated with the exiting flows meeting between the nozzles.

Another nozzle for obtaining a positive pressure pad with a parallel flow is described in U.S. Pat. No. 4,414,757. This nozzle modifies the basic Coanda type parallel unidirectional flow nozzle (FIG. 1) to produce a positive pressure pad without impingement of air against the web. This nozzle is herein termed the modified double slot nozzle. Extensive experimental work has shown that this technique can produce a pressure pad that is longer in the machine direction than the nozzle. It has no high spikes of pressure and can be configured, through proper selection of the design dimensions, to yield a web undulation pattern that maintains continuous curvature along the entire machine.

This modified double slot nozzle can provide pressure pad forces that are greater than those obtainable with the double impingement nozzle at the same conditions of flow and heat transfer. Furthermore, it retains the flow uniformity advantages of the unidirectional parallel flow nozzle and improves upon its heat transfer uniformity. The dimensional relationships obtained from the experimental investigation constitute the subject of the present invention.

The pressure level of the pressure pad shown in FIG. 9 is governed by the nozzle spacing which influences the kinetic pressure of the carry-over flow 5 and by the relative sizes of the primary jet 1 and the secondary jet 6. Processing difficulties may arise where there is a low or no pressure region which will allow the web to curl at the edges or to form wrinkles. The problem is further complicated by the fact that the nozzle spacing in a dryer will vary depending on the maximum drying rate required and the optimization of cost. In accordance with the present invention, the modified double slot nozzle is used to maximum advantage by optimizing the relationships of the spacing between the nozzles and the nozzle lengths in the machine direction.

If the size of secondary jet on the nozzle is too large in relation to the size of the primary jet, the Coanda effect will break down and the nozzle will become a skewed double impingement nozzle. As the secondary jet decreases in size, the pressure pad becomes weaker until at a secondary jet size of zero, the nozzle degenerates to a conventional parallel flow Coanda nozzle 101 as shown in FIG. 1.

SUMMARY OF INVENTION

In accordance with the present invention it has been found that the disadvantages of the nozzles employed in the prior art for web drying can be significantly reduced by utilizing a modified double slot nozzle and maintaining a proper distance between nozzles and by optimizing the spacing of the slots within a given nozzle. The preferred range of distance between nozzles has been found to be a continuum defined by the following points:

(i) 75–125 mm for a 50 mm nozzle;
(ii) 125–200 mm for a 75 mm nozzle;
(iii) 175–275 mm for a 100 mm nozzle;
(iv) 225–325 mm for a 125 mm nozzle;
(v) 275–350 mm for a 150 mm nozzle;
(vi) 325–375 mm for a 175 mm nozzle;
(vii) 375–400 mm for a 200 mm nozzle and
(viii) 425 mm for a 225 mm nozzle.

for each row of nozzles parallel to the web, where each nozzle on the upper row is between two nozzles on the bottom row of the web, with no more than 12.5 mm overlap. The optimum slot width of the secondary jet has been found to be in the range of 35% to 45% of the slot width of the primary jet, with 40% to 45% being preferred.

Accordingly, it is an object of the present invention to provide a system for drying a web which yields the most effective means of controlling sheet edge curl and wrinkling.

The advantages of the present invention will become apparent from the following description taken in conjunction with the drawing.

DESCRIPTION OF THE PREFERRED EMBODIMENT

At the outset the invention is described in its broadest overall aspects with a more detailed description following. The broadest overall aspects of the invention involve (1) optimizing the distance between two modified double slot nozzles and (2) modifying the relationship between the opening of the primary slot and the secondary slot on a modified double slot nozzle to produce a more uniform pressure pad throughout a web drying assembly.

Figure 1:
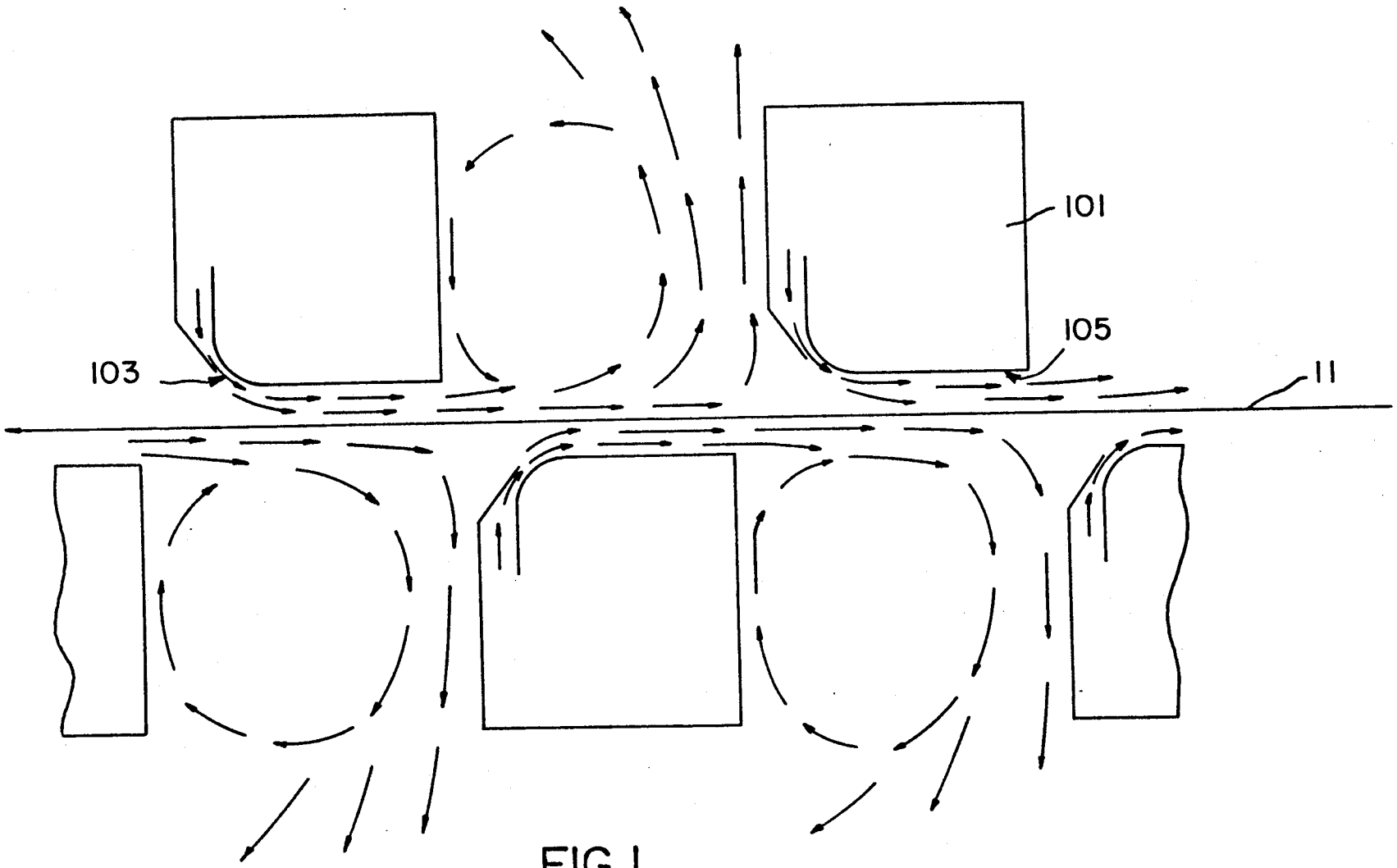
FIG. 1 PRIOR ART
FIG. 1 is a diagrammatic view showing a prior art dryer employing the single slot nozzle.
Figure 2:
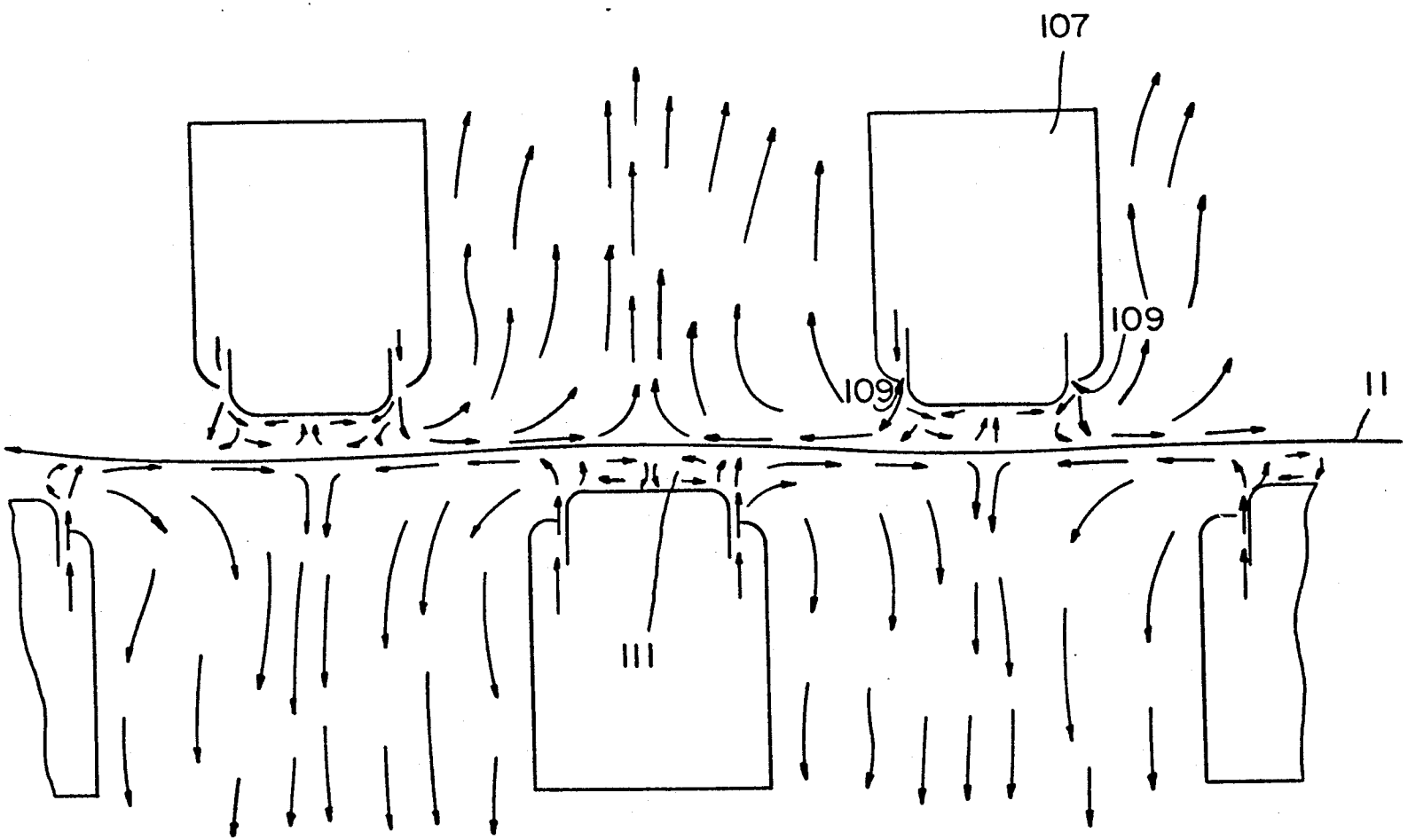
FIG. 2 is a diagrammatic view showing a prior art dryer assembly employing the double slot impingement nozzle.
Figure 3:
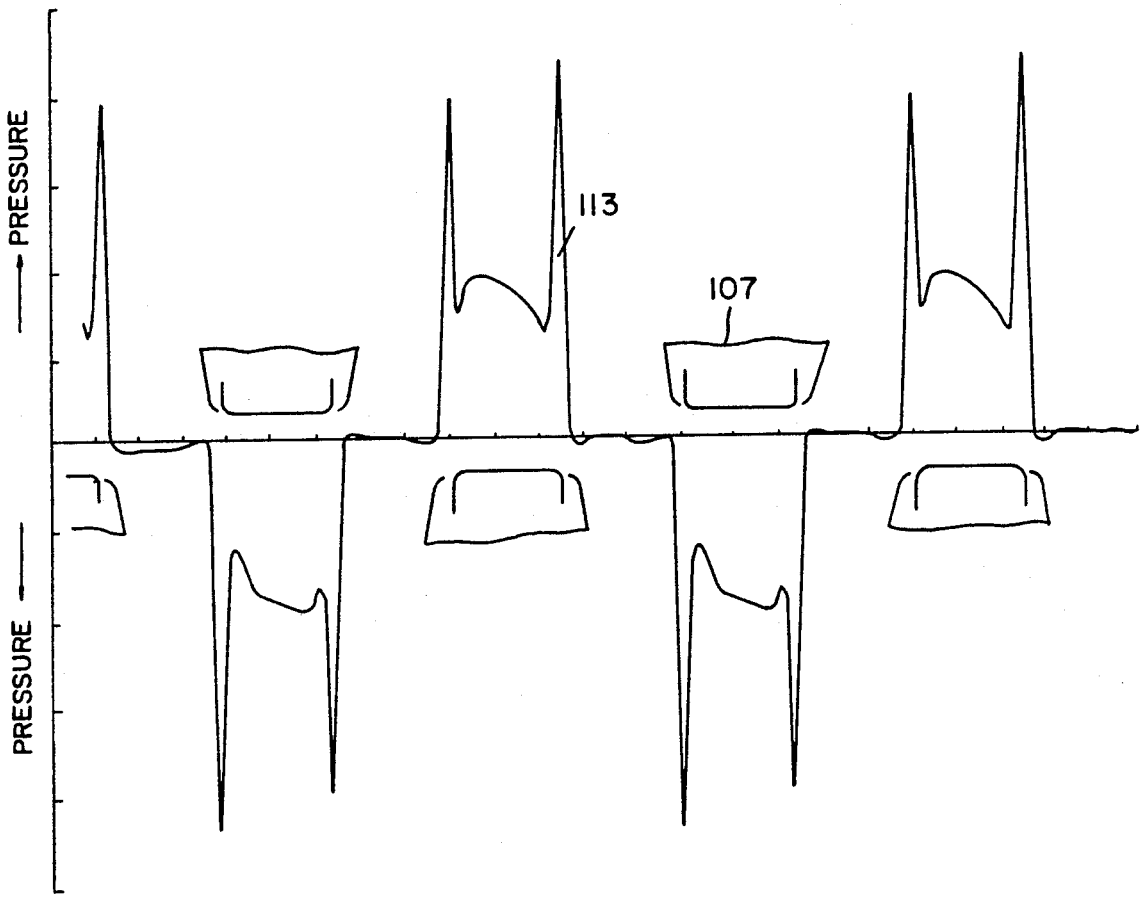
FIG. 3 is a graphic representation of a pattern of pressure pads formed by an arrangement of typical double impingement nozzles of the type shown in FIG. 2, as arranged in a typical dryer.
Figure 4:
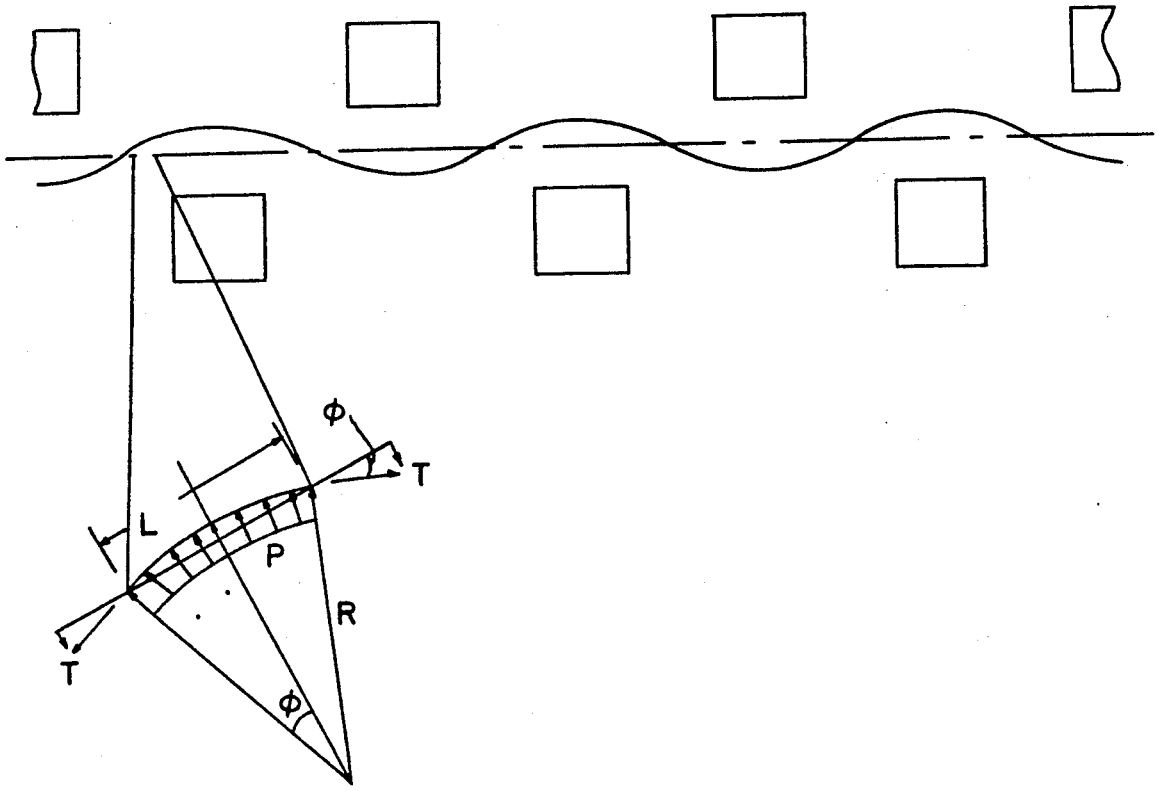
FIG. 4 is a diagrammatic view showing the effect on the web of the pattern of pressure pads formed by the double impingement nozzles of the type shown in FIG. 2, as arranged in a typical dryer.
Figures 5, 6, 7:
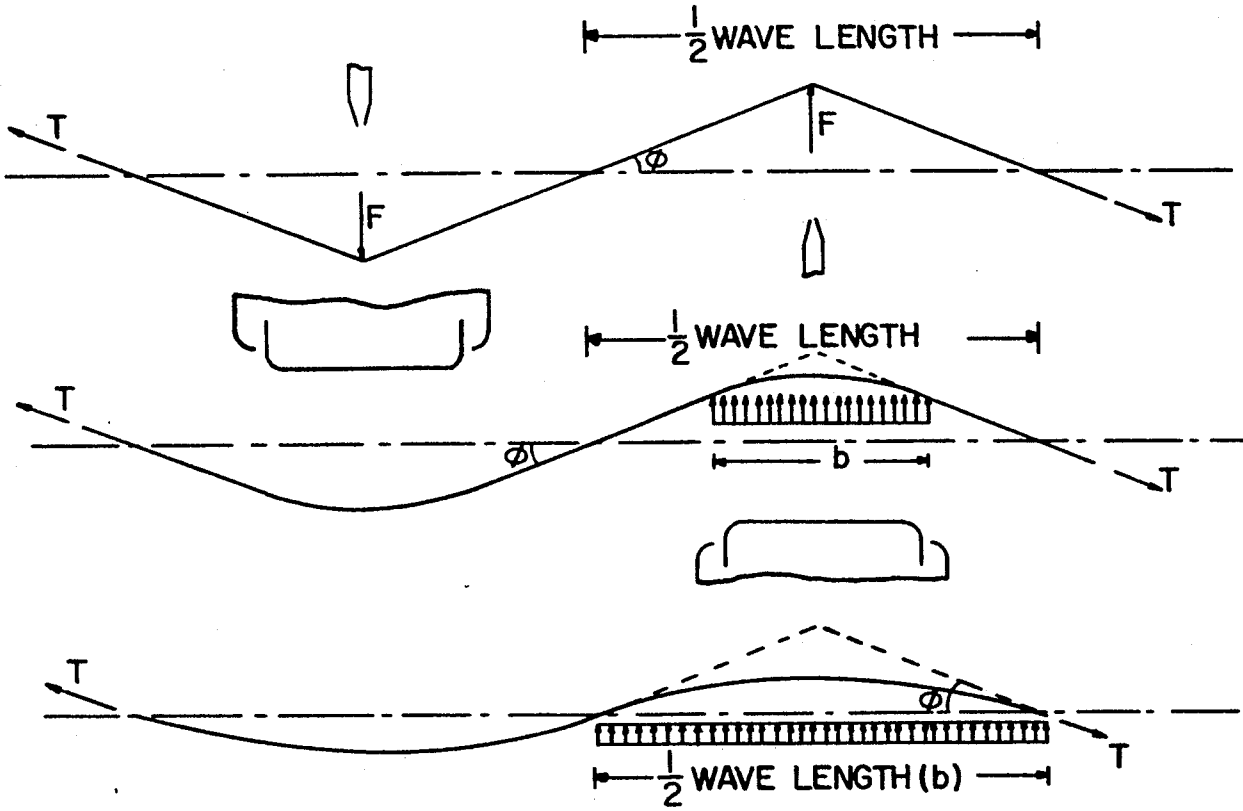
FIG. 5 is a diagrammatic view showing the jagged undulation wave formed by the single slot nozzles of the type shown in FIG. 1, as used in a typical dryer.
FIG. 6 is a diagrammatic view showing the wave curvature of the web when the double slot impingement nozzle of the type shown in FIG. 2 is used in a typical dryer.
FIG. 7 is a diagrammatic view showing the wave curvature of the web where the pressure region is made to be equal to half the undulation wave length.
Figure 8:
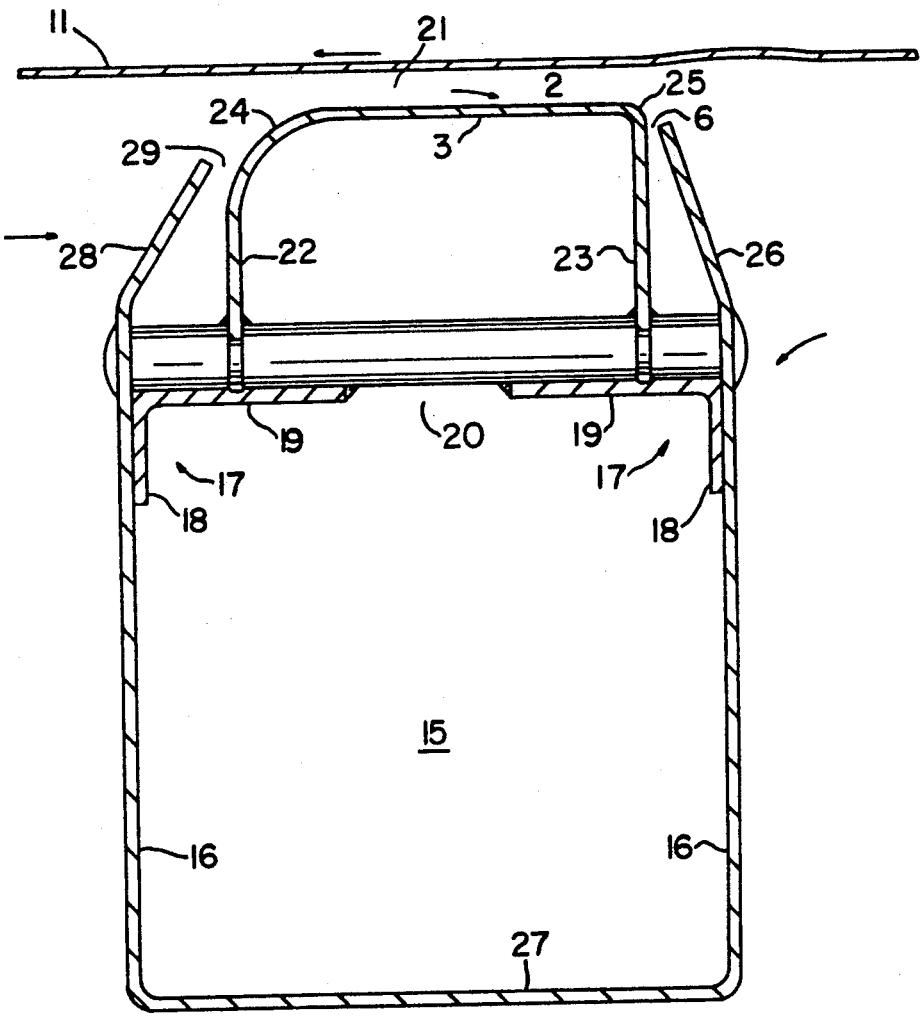
FIG. 8 is a sectional view showing a prior art modified double slot nozzle.

The invention utilizes the modified double slot nozzle as shown in U.S. Pat. No. 4,414,757. A sectional view of that nozzle is shown in FIG. 8 and generally comprises an elongated plenum chamber 15, upstream and downstream vertical side plates 16, and a base plate 27. The upper portion of the plenum chamber 15 is defined by a pair of L-shaped angle members 17 having vertical legs 18 attached to side plates 16 and horizontal legs 19 which extend inwardly toward each other to form an elongated gas discharge slot 20 for the plenum. The length of the nozzle is the length of the base plate 27.

A U-shaped assembly 21 is mounted between the outer wall of the chamber 15 formed by the horizontal legs 19 and the web 4. The plate assembly comprises a vertical upstream wall 22, a vertical downstream wall 23, and a horizontal flat pressure plate 3 joining the walls. The upstream corner 24 joining wall 22 and pressure plate 3 is curved, and the downstream corner 25 joining 23 and pressure plate 3 is at a relatively substantially right angle.

The upstream side plate 16 extends vertically beyond upstream leg 19 to merge into inwardly inclined foil plate 28. The space between the end of the inwardly inclined foil plate 28 and the covered corner 24 forms the primary gas discharge slot 29.

A secondary slot is formed at the downstream end of the assembly by extending the downstream plenum side plate 16 beyond downstream leg 19 to merge into an inwardly inclined plate 26 which terminates just short of pressure plate 3.

Figure 9:
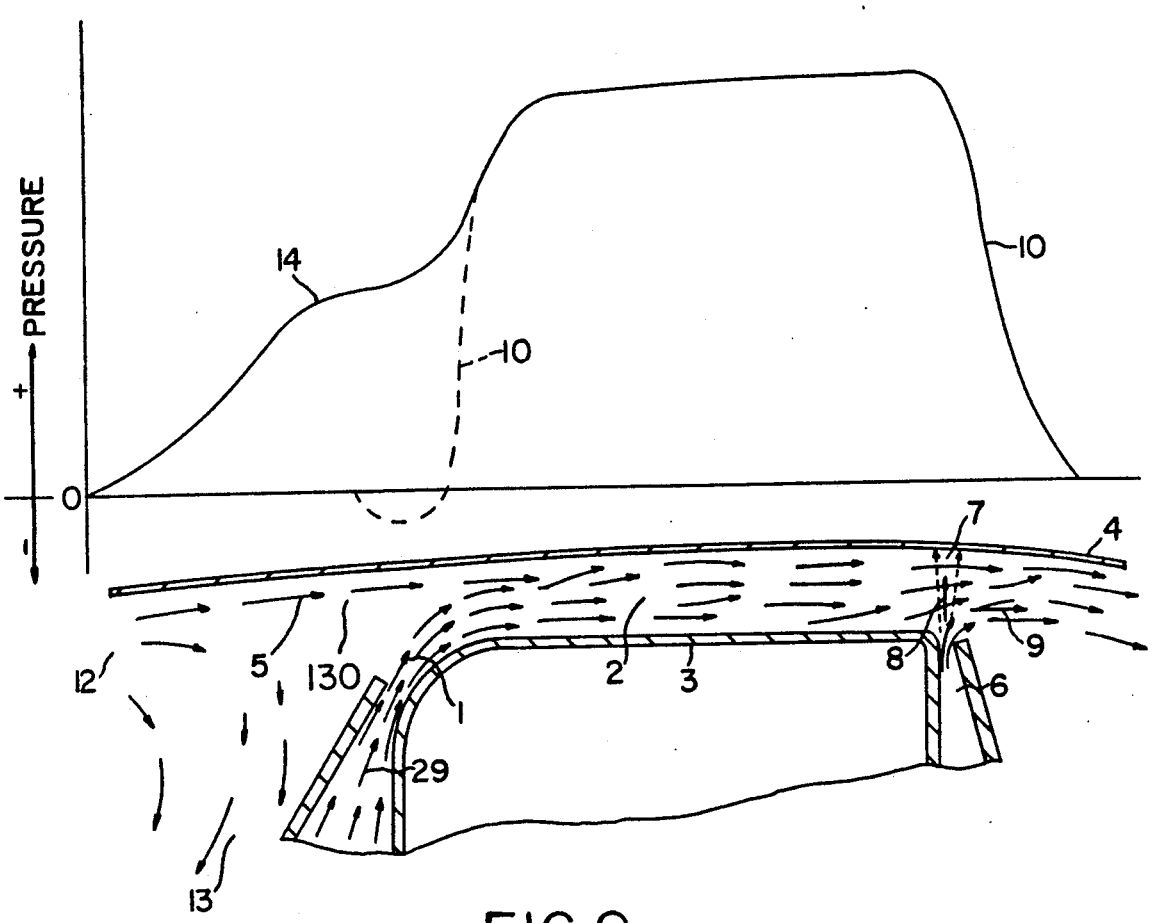
FIG. 9 is a diagrammatic representation showing the modified double slot nozzle of the type shown in FIG. 8 and the shape of a typical pressure pad created by that nozzle.

The gas flow characteristics of the nozzle are illustrated in FIG. 9. A stream of air 1 flows from the primary jet and runs by means of the Coanda Effect to flow into the space 2 between the pressure plate 3 and the web 4. In addition, a portion 5 of the residual flow from the preceding nozzle joins the primary jet flow to form the total flow stream in region 2. At the trailing edge of the pressure plate 3, a secondary nozzle 6 aims a jet 7 essentially normal to the web and a the same velocity as the primary jet.

A portion of the momentum in the flow stream coming from the primary jet 1 and the carry-over flow 5 is converted into pressure as it turns the momentum vector 8 of the secondary jet 7 from a direction perpendicular to the web to a direction parallel to the web 9. Because pressure is a scaler quantity, it acts in the entire region between the primary and secondary jets. Thus this nozzle creates a pressure pad by raising the static pressure in the parallel flow and not by impinging flow at the web.

The shape of the pressure pad for a single nozzle is identified by 10 in FIG. 9. In a sequential array of nozzles, a small fraction of the parallel flow 130 from the preceding nozzle enters the region 2 but most of it 12 is caused to turn and flow away between the nozzles 13. What actually happens is that the residual velocity of the parallel flow 12 is converted into pressure. This pressure is then converted into the velocity perpendicular to the web represented by the exhaust flow 13. In the other direction, this stagnation pressure creates an added component to the pressure pad 14.

Figure 10:
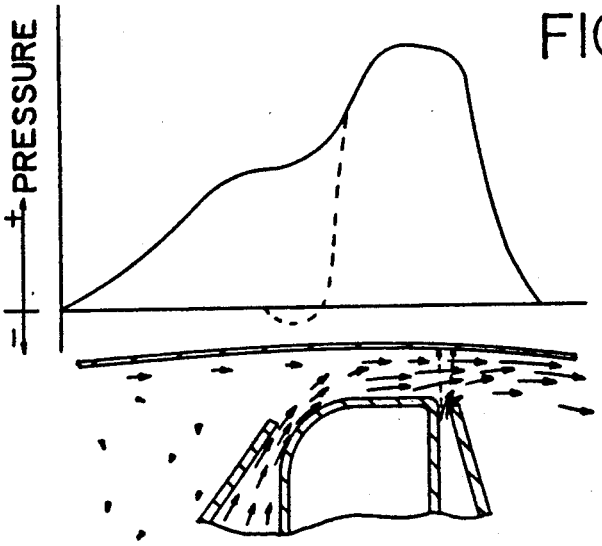
FIGS. 10–12 are diagrammatic views showing the change in the length of the nozzle versus the change in the length of the pressure pad.
Figure 11:
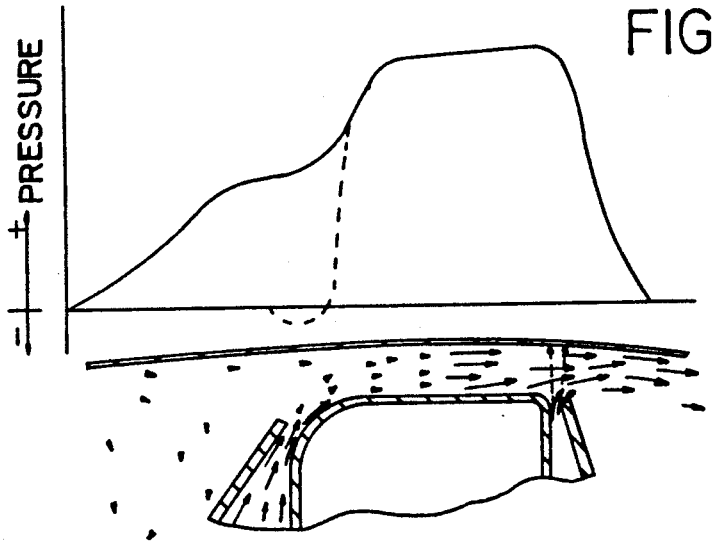
Figure 12:
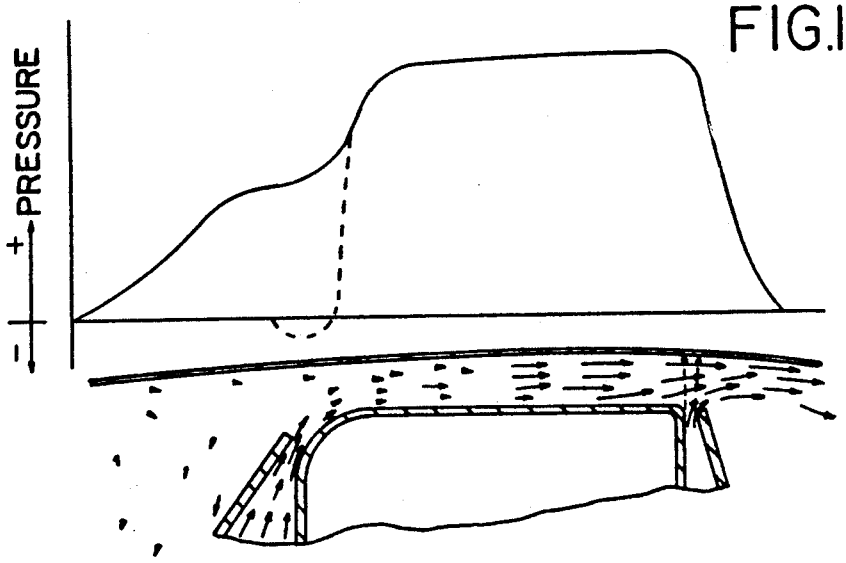
Figure 13:
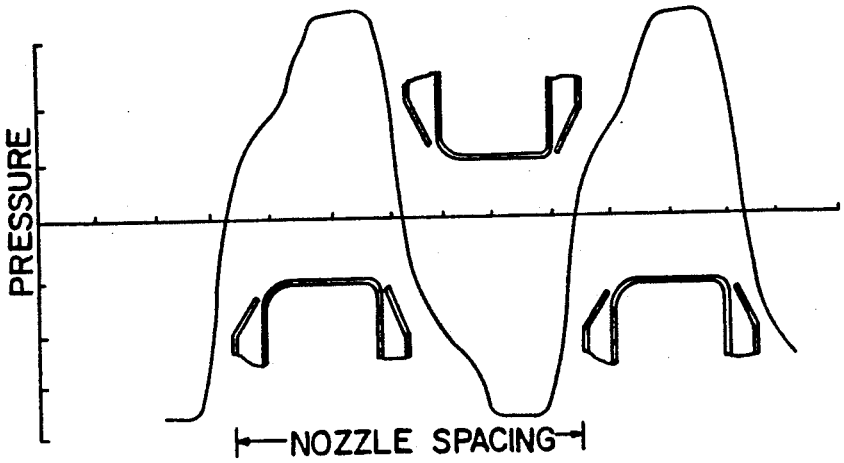
FIGS. 13–15 are diagrammatic views showing the change in the nozzle spacing versus the change in the size and the shape of the pressure pad.
Figure 14:
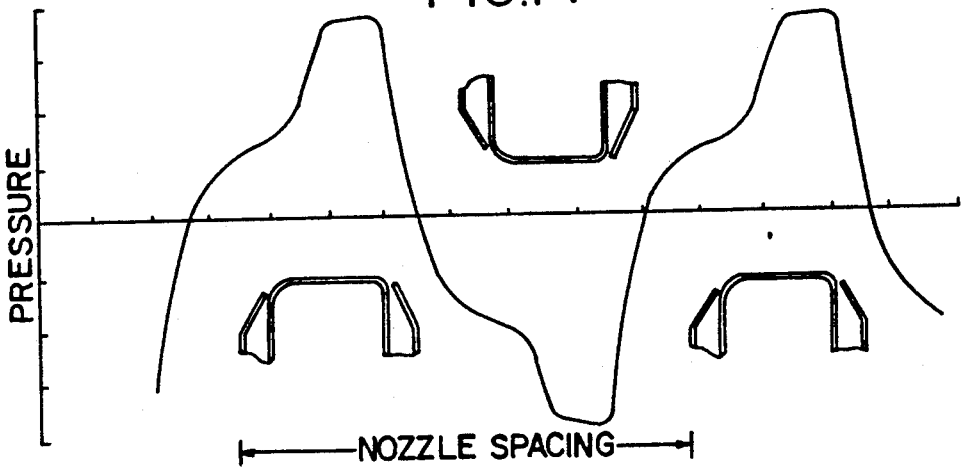
Figure 15:
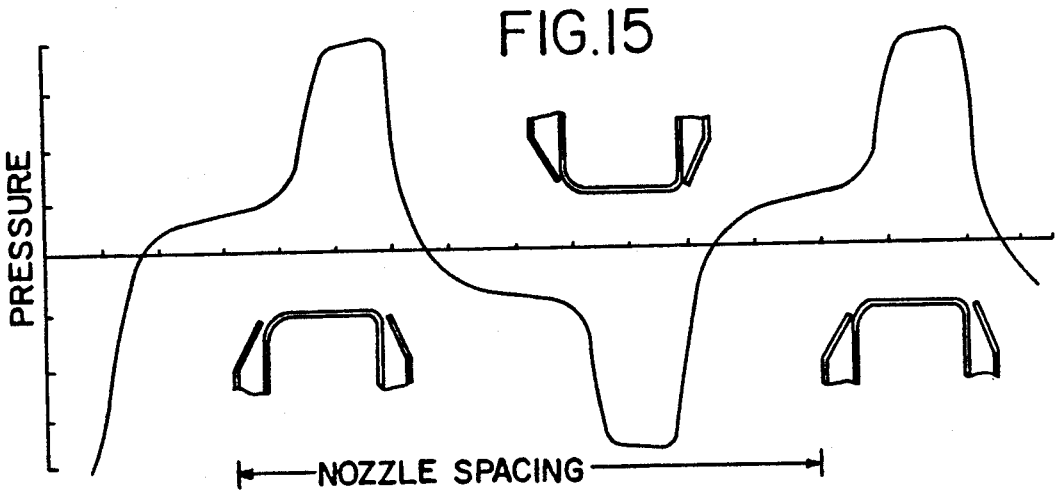
Figure 16:
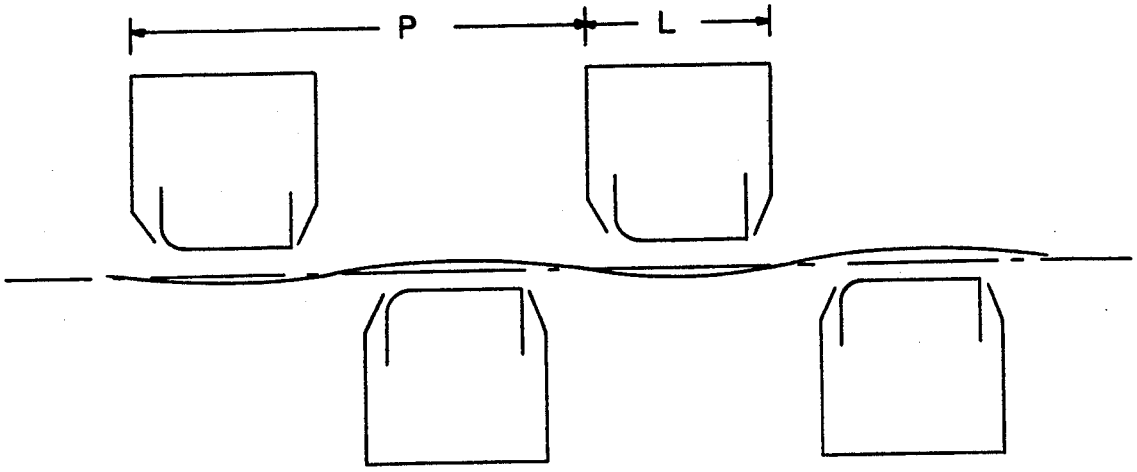
FIG. 16 is a diagrammatic view showing the modified double slot nozzles of the type shown in FIG. 8 arranged in a typical dryer at a distance apart such that there is no danger that the web will rub against the nozzles.
Figure 17:
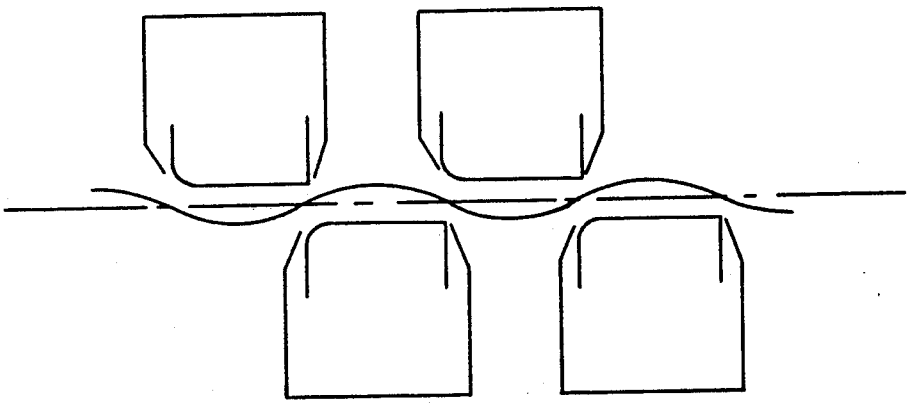
FIG. 17 is a diagrammatic view of the modified double slot nozzles of the type shown in FIG. 8 arranged so close together in a typical dryer that there is a danger that the web will rub against the nozzles.
Figure 18:
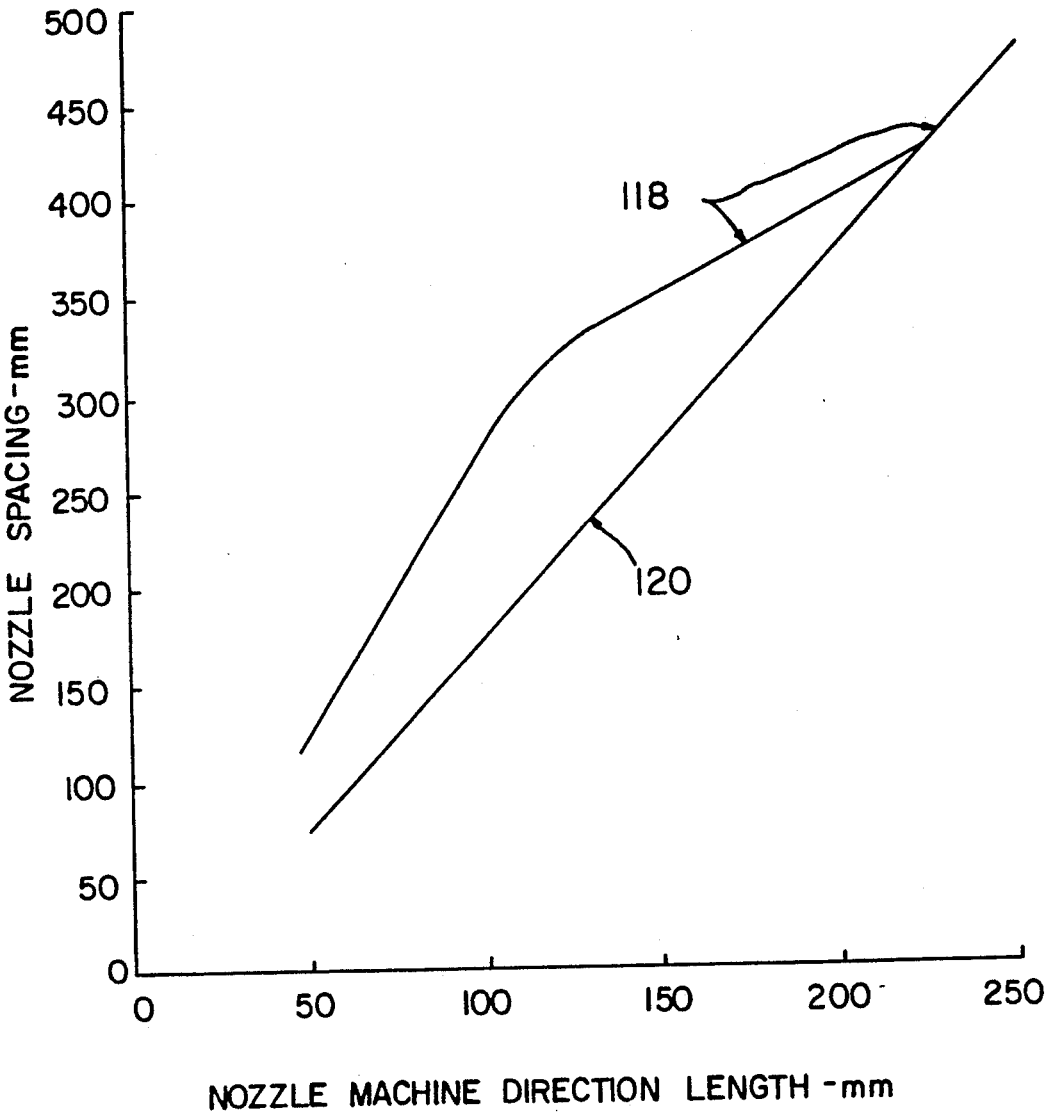
FIG. 18 is a graph defining the preferred range of dimensions for the modified double slot nozzle of the type shown in FIG. 8 to yield optimal condition of web curvature for curl and wrinkle resistance.

The length of the pressure pad in the direction of web travel is governed by the length of the pressure plate 3 and by the spacing between the nozzles. Since the pressure wave formed by the momentum direction change of the secondary jet travels upstream at the speed of sound, the length of the primary portion 10 of the pressure pad will be directly proportional to the length of the pressure plate 3 for any practical nozzle dimensions. This effect is illustrated in FIGS. 10–12. The magnitude of the secondary portion of the pressure pad will be inversely proportional to the nozzle spacing but its length will not significantly change. At large spacings, this secondary portion 14 becomes so weak that it contributes little to the curvature of the web. This effect is illustrated in FIGS. 13–15. At close spacing the pressure pad provides improved coverage of the web. In the limit when the nozzles above and below the web begin to overlap, there is insufficient physical space to accommodate the undulation as shown in FIG. 16. Thus the limitations illustrated in these last two figures define the practical limits of nozzle spacing related to nozzle machine direction length. These can be summarized as shown in FIG. 18 which defines the preferred range of dimensions for this nozzle to yield optimal conditions of web curvature for curl and wrinkle resistance where the locus of optimum maximum spacing derived from experimental pressure traverse date is shown by 118 and the locus of practical minimum spacings is shown by 120.

To ensure the at the Coanda effect does not break down as where the secondary jet is too large, or that the pressure pad does not become too weak, as where the secondary jet is too small, the slot width for the secondary jet should ideally lie in the range of 35% to 45% of the slot width of the primary jet, with 40% to 45% being preferred.

What is claimed is:

1. A dryer assembly for drying a moving flexible continuous web of material, said assembly including a plurality of nozzles, each of said nozzles comprising:

(a) an elongated plenum chamber defined by a base plate, upstream and downstream vertical parallel side plates, and end closure plates, (b) a flat pressure plate adapted to form a gas flow zone with a moving web, (c) a primary jet of the airfoil Coanda type disposed at the upstream of the pressure plate continuously directing gas downstream along the face of the plate, (d) a single secondary jet of the impingement type disposed at the generally right angled downstream terminus of the pressure plate to continuously direct gas initially substantially perpendicularly to the web and to gas flowing downstream along the gas flow zone, wherein the preferred range of distance between nozzles has been found to be a continuum defined by the following points:

(i) 75–125 mm where the length of the base plate is 50 mm;

(ii) 125–200 mm where the length of the base plate is 75 mm;

(iii) 175–275 mm where the length of the base plate is 100 mm;

(iv) 225–325 mm where the length of the base plate is 125 mm;

(v) 275–350 mm where the length of the base plate is 150 mm;

(vi) 325–375 mm where the length of the base plate is 175 mm;

(vii) 375–400 mm where the length of the base plate is 200 mm or;

(viii) 425 mm where the length of the base plate is 225 mm, said nozzles forming rows above and below and parallel to the web, wherein each nozzle on the upper row is between two nozzles on the bottom row of the web, with no more than 12.5 mm overlap.

2. The dryer assembly according to claim 1 wherein in the nozzle the slot width of the secondary jet is in the range of 35% to 45% of the slot width of the primary jet, with 40% to 45% being preferred.

* * * * *